US006863551B2

(12) United States Patent
Fukamachi

(10) Patent No.: US 6,863,551 B2
(45) Date of Patent: Mar. 8, 2005

(54) CONNECTOR, SET OF CONNECTORS AND METHOD OF CONNECTING A CONNECTOR

(75) Inventor: Makoto Fukamachi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/823,857

(22) Filed: Apr. 14, 2004

(65) Prior Publication Data

US 2004/0209503 A1 Oct. 21, 2004

(30) Foreign Application Priority Data

Apr. 15, 2003 (JP) ..... 2003-110730

(51) Int. Cl.[7] ..... H01R 13/62
(52) U.S. Cl. ..... 439/157; 439/489
(58) Field of Search ..... 439/157, 489, 439/372

(56) References Cited

U.S. PATENT DOCUMENTS

| | | | | |
|---|---|---|---|---|
| 5,476,390 A | | 12/1995 | Taguchi et al. | |
| 6,116,928 A | * | 9/2000 | Tsuji et al. | 439/157 |
| 6,332,788 B1 | * | 12/2001 | Okabe et al. | 439/157 |
| 6,485,317 B2 | * | 11/2002 | Gundermann et al. | 439/157 |
| 6,666,697 B2 | * | 12/2003 | Yamashita | 439/157 |
| 2004/0023535 A1 | * | 2/2004 | Gundermann et al. | 439/157 |

* cited by examiner

*Primary Examiner*—Tho D. Ta
(74) *Attorney, Agent, or Firm*—Gerald E. Hespos; Anthony J. Casella

(57) ABSTRACT

Male housings (10, 20) have erroneous connection preventing structures (32, 16), and the connection of the housings (10, 20) is prevented at a preventing position (PP) located before an initial connection position (ICP) if the housings (10, 20) are connected erroneously. When a lever (40) is rotated in this state, push-back surfaces (49) formed at opening edges of cam grooves (44) push cam pins (13) back to separate the two housings (10, 20). Thus, the lever (40) can be prevented from damage.

15 Claims, 8 Drawing Sheets

CONNECTOR, SET OF CONNECTORS AND METHOD OF CONNECTING A CONNECTOR

BACKGROUND OF THE INVENTION

1. Field of the Invention

The invention relates to a connector, a set of connectors and connecting a method.

2. Description of the Related Art

U.S. Pat. No. 5,476,390 discloses a lever-type connector with male and female housings. A lever is mounted rotatably on the female housing and has a cam groove that is engageable with a cam pin on the male housing. The lever initially is held at a starting position and the male housing is positioned so that the cam pin faces the entrance of the cam groove. The lever then is rotated to move the cam pin along the cam groove. As a result, the housings are pulled toward and connected with each other. Thus, the connector takes advantage of the leverage action of the lever and connects the housings with a smaller force.

Some of lever-type connectors have an erroneous connection preventing means for preventing connection of the female and male housings in a wrong combination. The erroneous connection preventing means includes a rib extending in a connecting direction on one housing and a groove on the mating housing for receiving the rib. The positions of the rib and the groove differ for each pair of housings so that the male and female housings can be connected only in a correct combination. The rib is displaced from the groove if an attempt is made to connect the male and female housings in a wrong combination. Thus, the rib contacts an end surface of the mating housing to prevent the connection.

A cam pin that is at the entrance to the cam groove may interfere with an edge of the cam groove and may damage the lever if an operator tries to turn the lever in a state where connection of the housings is prevented.

The present invention was developed in view of the above problem and an object thereof is to provide prevent a connector from being damaged upon erroneously connecting a male and a female connector housings.

SUMMARY OF THE INVENTION

The invention relates to a connector with first and second housings that are connectable with each other. A movable member is provided on the first housing and has a cam groove. A cam pin is provided on the second housing. The housings are fit lightly together so that the cam pin engages the cam groove. The movable member can be moved from an initial connection position so that the housings are pulled together and connected properly. However, an erroneous connection preventing means is provided at a preventing position which is located before the initial connection position. The erroneous connection preventing means prevents connection of erroneously oriented housings even though at least a part of the cam pin is in the cam groove. A push-back surface is formed at an opening edge of the cam groove and exerts a force on the cam pin to separate the housings. The force exerted by the push-back surface exceeds a frictional resistance between the housings. Thus, the movable member is prevented from damage The movable member preferably is a lever rotatably provided on the first housing.

A contacting direction of the push-back surface with the cam pin preferably defines an angle of about 45° or smaller to a connection axis of the housings. Accordingly, a component of a pushing force that the cam pin receives from the push-back surface acts along the connection axis and has a small value even if the push-back surface contacts the cam pin in a downwardly tilted direction. The value of the pushing force necessary to separate the housings becomes larger, and the operable member may be damaged if such a force is exerted. However, the contacting direction of the push-back surface with the cam pin defines an angle of 45° or smaller to a connection axis of the housings. Therefore, the value of the component acting along the connection axis is relatively large and the housings can be separated with a smaller force, thereby preventing the operable member from being damaged.

The push-back surface preferably comprises or is a convex surface. Accordingly, a contact area of the push-back surface with the cam pin is reduced and friction between the cam pin and the push-back surface is suppressed by the convex push-back surface.

The erroneous connection preventing means preferably comprises at least one groove and at least one rib that is insertable into the groove upon proper connection of the two housings.

The invention also relates to a set of connectors comprising two or more of the above-described connectors. The positions of the rib and the groove differ for each pair of male and female housings in a set of connectors so that the housings can be connected only in a correct combination.

These and other features of the invention will become more apparent upon reading the following detailed description and accompanying drawings. It should be understood that even though embodiments are separately described, single features thereof may be combined to additional embodiments.

DETAILED DESCRIPTION OF THE PREFERRED EMBODIMENTS

Figure 1:
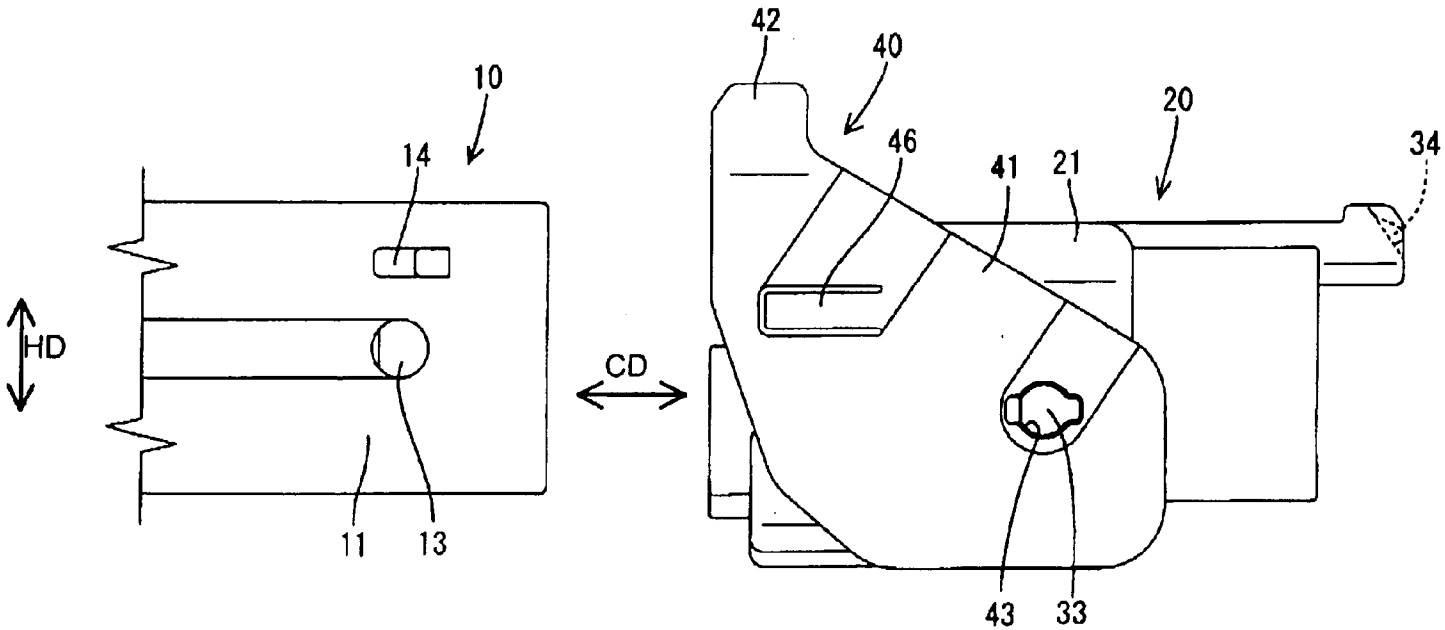
FIG. 1 is a side view showing a state before male and female housings of the invention are connected.

A lever-type connector according to the invention is shown in FIG. 1, and includes a male housing 10 and a female connector housing 20 connectable with each other along a connecting direction CD. A lever 40 is mounted on the female housing 20. In the following description, sides of the respective housings 10, 20 to be connected are referred to as the front side.

Figure 2:
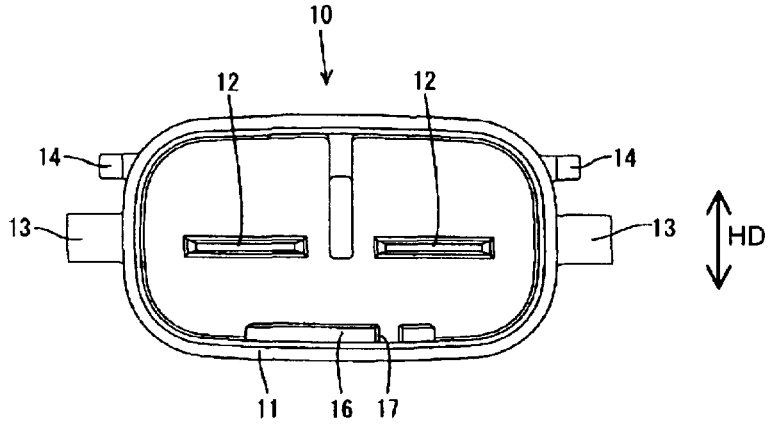
FIG. 2 is a front view of the male housing.

The male housing 10 is made e.g. of a synthetic resin, and is formed integrally with an unillustrated device. The male housing 10 includes a substantially rectangular tubular fitting 11 that projects forward along the connecting direction CD, as shown in FIGS. 1 and 2. Two tabs 12 of male terminal fittings project substantially side by side from the back wall of the tubular fitting portion 11. Substantially cylindrical cam pins 13 project from the left and right outer surfaces of the tubular fitting portion 11 at positions slightly towards the front end in an intermediate portion with respect to the height direction HD. An unlocking projection 14 projects above each cam pin 13.

Figure 3:
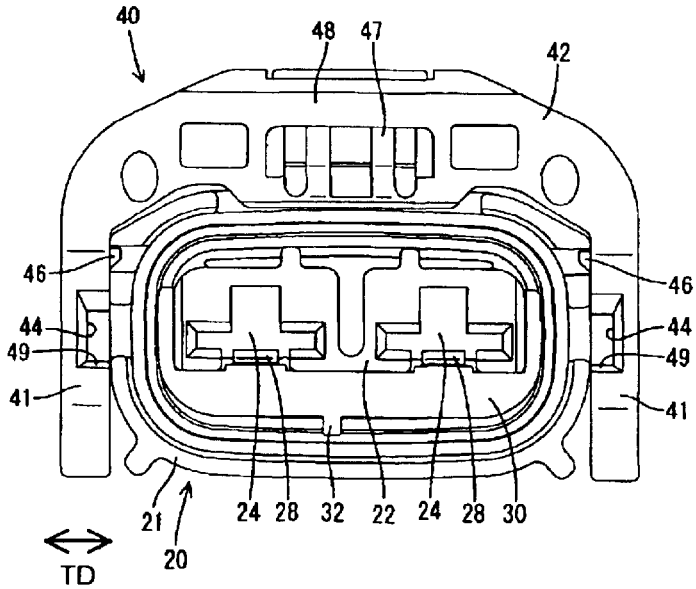
FIG. 3 is a front view of the female housing.
Figure 5:
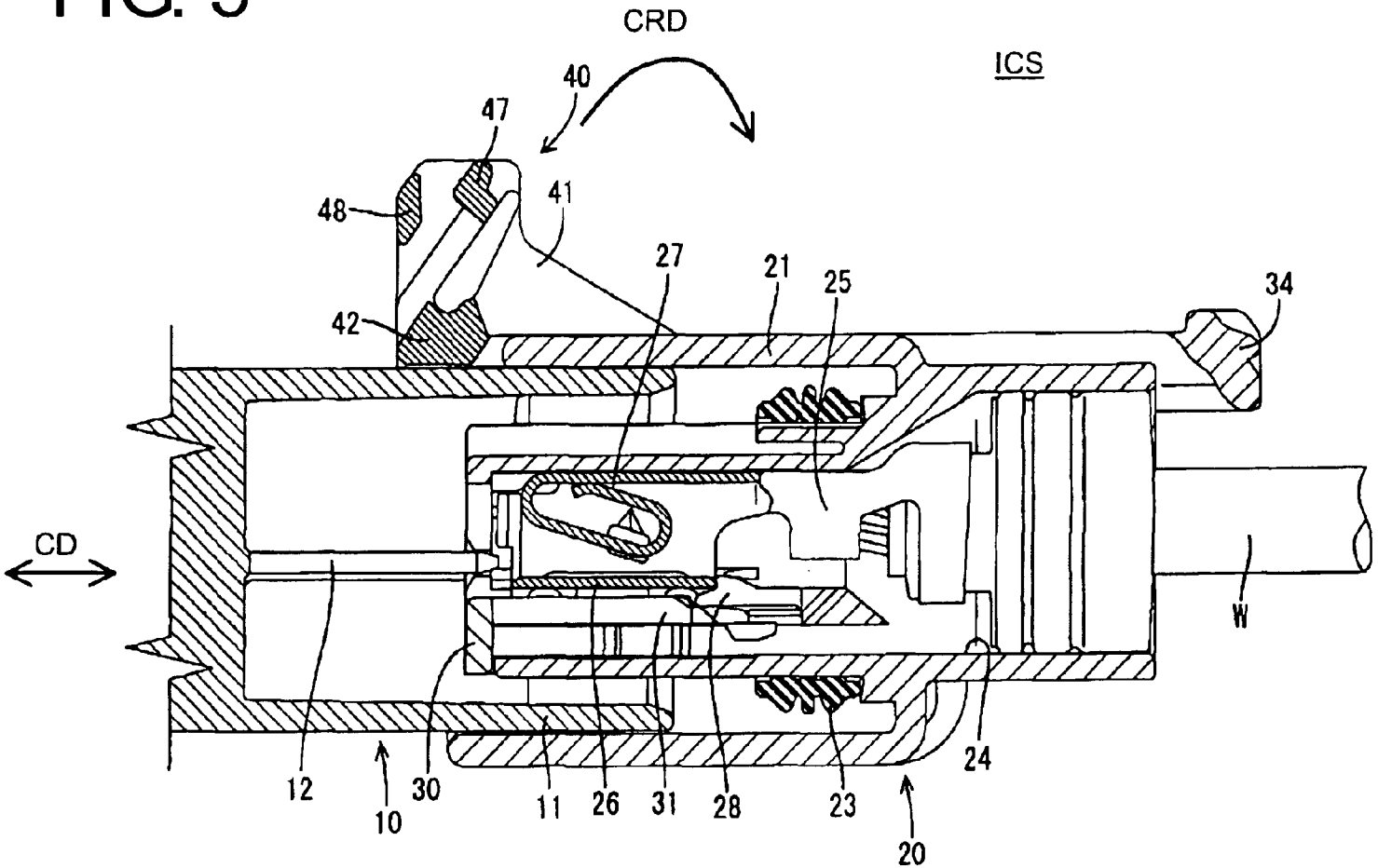
FIG. 5 is a section showing a state where the male and female housings are at an initial connection position.

The female housing 20 also is made e.g. of a synthetic resin. A receptacle 21 projects from the front surface of the female housing 20 for receiving the tubular fitting 11 of the male housing 10 and a tower 22 is formed in the receptacle 21 as shown in FIGS. 3 and 5. The tower 22 is fittable into the tubular fitting 11. A seal ring 23 is mounted on the rear end of the outer peripheral surface of the tower 22, so that the outer peripheral surface of the seal ring 23 is brought into close contact with the inner peripheral surface of the tubular fitting 11 to close the inside of the connector in a watertight manner when the housings 10, 20 are connected properly. Left and right cavities 24 extend forward and back substantially along the connecting direction CD in a section that extends from the front end of the tower 22 to the rear end of the female housing 20. A female terminal fitting 25 is connected with an end of a wire W and is at inserted into each cavity 24 in an inserting direction from behind. A rectangular tubular terminal connecting portion 26 is formed at a front end of the female terminal fitting 25, and a resilient contact piece 27 is folded back from the front edge of the upper wall of the terminal connecting portion 26. The tab 12 of the male terminal fitting can be inserted into the terminal connecting portion 26 from the front and a bottommost portion of the resilient contact piece 27 is brought resiliently into contact with the tab 12 to connect the male and female terminal fittings 12, 25 electrically. A lock 28 is cantilevered from an inner wall of each cavity 24 and is resiliently deformable up and down in a direction intersecting the inserting direction. The leading end of the lock 28 engages the rear edge of the terminal connecting portion 26 to hold the female terminal fitting 25 in a locked state. A retainer 30 made e.g. of a synthetic resin is mountable on the tower 22 from the front. The retainer 30 is provided with left and right deformation preventing pieces 31 extending backward. The leading ends of the respective deformation preventing pieces 31 are inserted into deformation spaces for the locks 28 to prevent the resilient deformation of the locks 28. As a result, the female terminal fittings 25 can be locked doubly.

Figure 4:
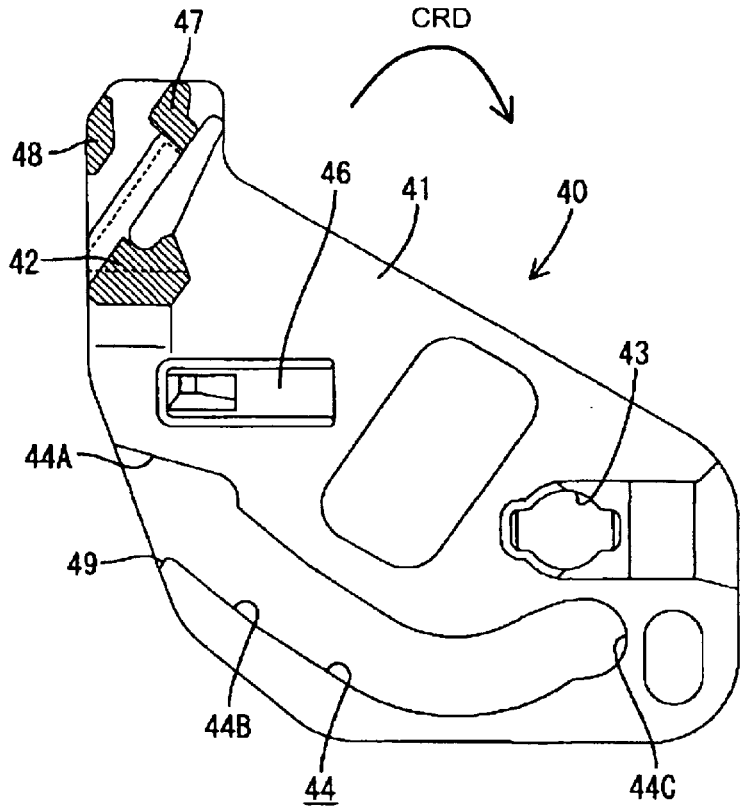
FIG. 4 is a section of a lever.

The lever 40 is made e.g. of a synthetic resin and defines a substantially U-shape with left and right arms 41 and a coupling portion 42 as shown in FIGS. 1, 3 and 4. The lever 40 is mounted to span the receptacle 21 of the female housing 20 from left and right sides. More particularly, shaft bearing holes 43 at the leading ends of the arms 41 are supported rotatably with the shafts 33 that project from the corresponding left and right outer surfaces of the receptacle 21. A cam groove 44 is formed in the inner surface of each arm 41 (see FIG. 4) and is engageable with the corresponding cam pin 13 of the male housing 10. The cam groove 44 extends from an entrance 44A at an end edge of the arm 41 to a terminus 44C via a connection guiding groove 44B. The connection guiding groove 44B is shaped to approach the bearing hole 43 as it extends toward the back side.

Figure 6:
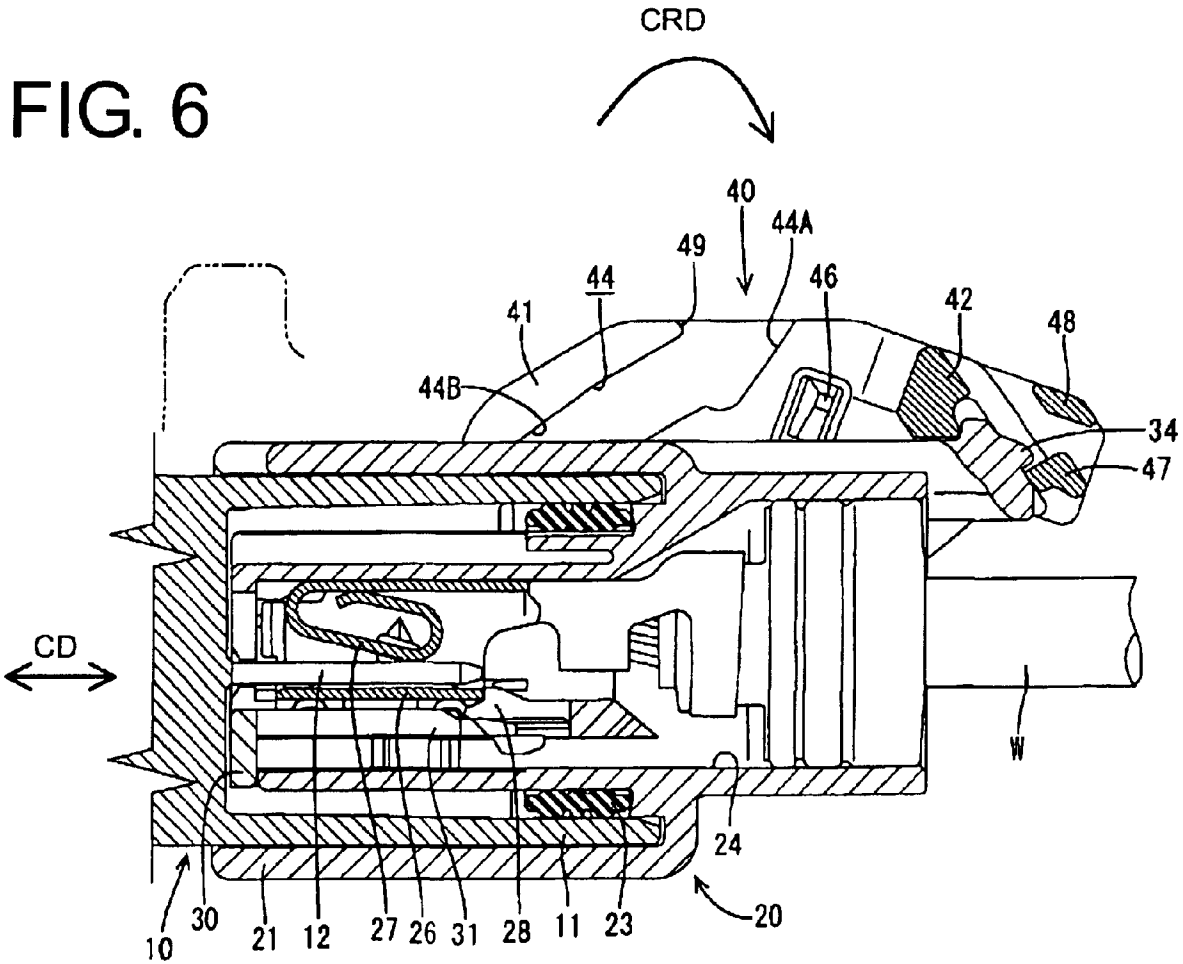
FIG. 6 is a section showing properly connected the male and female housings.

The lever 40 is mounted at a starting position (see FIG. 1) so that the entrances 44A of the cam grooves 44 face forward toward the cam pins 13. The two housings 10, 20 then are connected lightly to an initial connection position ICP shown in FIG. 5. Thus, the cam pins 13 engage the entrances 44A of the cam grooves 44. The lever 40 then is rotated in a connection rotation direction CRD (clockwise in FIG. 5). As a result, the cam pins 13 are displaced along the connection guiding grooves 44B and display a cam action for connecting the two housings 10, 20. The two housings 10, 20 are connected properly when the lever 40 reaches an ending position where the cam pins 13 are at the termini 44C of the cam grooves 44, as shown in FIG. 6.

A locking piece 46 is provided on each arm 41 near the coupling 42 and is resiliently deformable along a thickness direction TD of the arm 41. The locking pieces 46 engage the front end of the receptacle 21 when the lever 40 is at the starting position (see FIG. 3). The unlocking projections 14 of the male housing 10 resiliently deform the locking pieces 46 out in a disengagement direction to disengage the locking pieces 46 from the receptacle 21 when the two housings 10, 20 are connected, thereby allowing the lever 40 to rotate.

A resiliently deformable lock arm 47 is cantilevered from an intermediate portion of the coupling 42, and a lock projection 34 extends back from an upper surface on the middle of the female housing 20. The lock arm 47 engages the lock projection 34 when the lever 40 reaches the ending position. Thus, the lever 40 is held so as not to rotate and the two housings 10, 20 are held connected. Further, an operable portion 48 is provided in the middle of the front surface of the coupling 42 at the starting position of the lever 40 for receiving fingers or an operation jig to rotate the lever 40.

Figure 7:
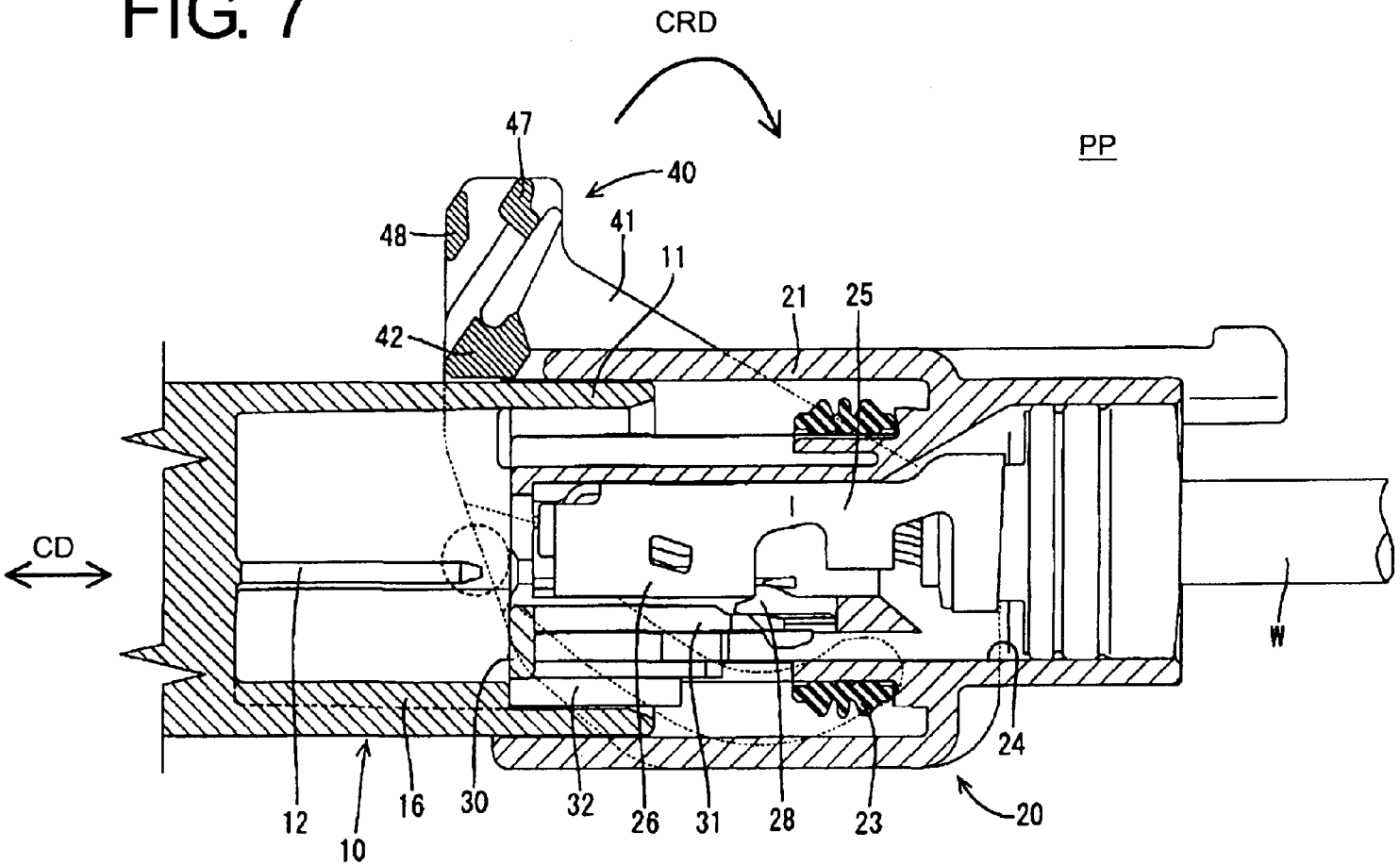
FIG. 7 is a section showing a state where the connection of the male and female housings is prevented.

This connector has an erroneous connection preventing means for preventing connection of the male and female connector housings 10, 20 in a wrong combination. Specifically, a rib 32 is formed at a specified position on the bottom surface of the retainer 30 of the female housing 20 and extends substantially forward and backward along a connecting direction CD. On the other hand, an erroneous connection preventing portion 16 in the form of a flat box, projects in an intermediate portion of the inner bottom surface of the tubular fitting 11 of the male housing 10, and has a groove 17 at a position corresponding to the rib 32. The groove 17 extends forward and back along the connecting direction CD. The positions of the rib 32 and the groove 17 differ for each pair of male and female housings among a set of connectors so that the male and female housings can be connected only in a correct combination. Thus, if an attempt is made to connect the male and female housings in a wrong combination, the rib 32 is displaced from the groove 17 and contacts the front end surface of the erroneous connection preventing portion 16, as shown in FIG. 7. As a result, the connection of the two wrongly paired housings 10, 20 can be prevented at a preventing position PP located before the initial connection position ICP with respect to the connecting direction CD.

Figure 8A:
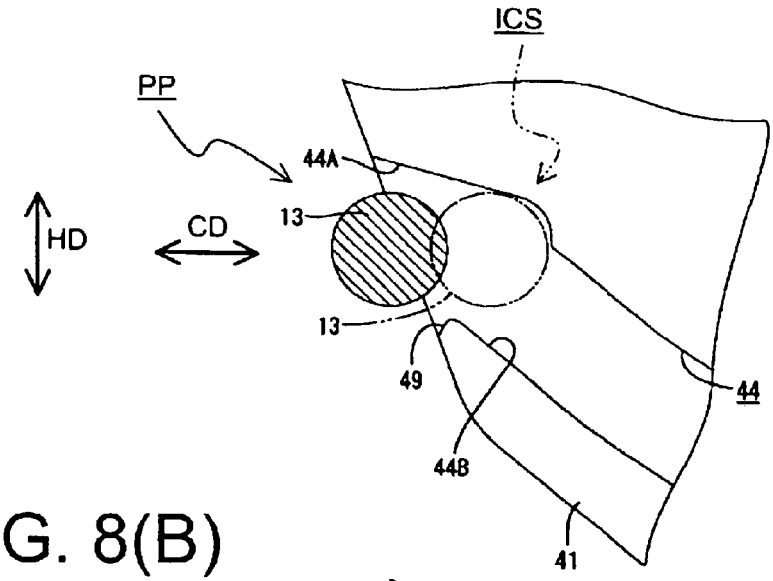
FIG. 8(A) is a partial enlarged section showing the position of a cam pin when the male and female housings are at a preventing position.

As shown in FIG. 8(A), a substantially flat push-back surface 49 is formed at a lower opening edge of the entrance 44A of each cam groove 44 at the starting position and is sloped down toward the end edge of the arm 41. The substantially flat push-back surface 49 is inclined to widen the width of the cam groove 44 at the entrance 44A. The two housings 10, 20 are connected to the initial connection state ICS. Thus, each cam pin 13 enters for more than about ⅔ of its extension along the connecting direction CD and substantially entirely enters the entrance 44A of the corresponding cam groove 44, as shown in phantom in FIG. 8(A). Thus, each cam pin 13 is located mostly behind the push-back surface 49 when seen with respect to the connecting direction CD. The lever 40 then is rotated in this state, and each cam pin 13 moves to the terminus 44C via the connection guiding groove 44B.

Figure 8B:
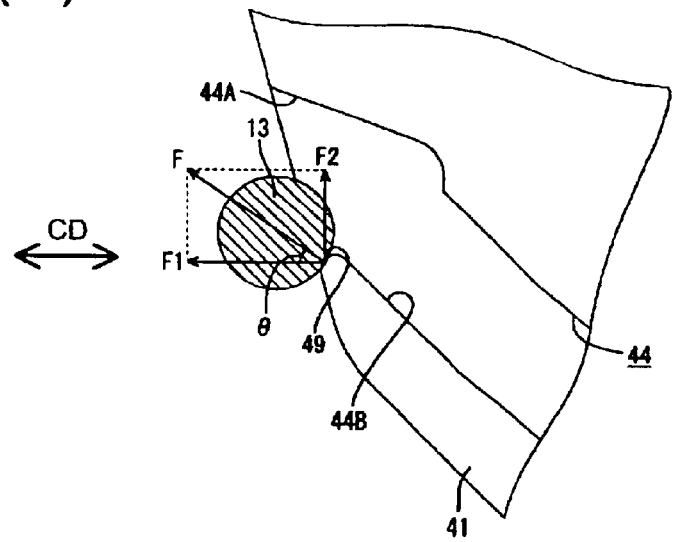
FIG. 8(B) is a partial enlarged section showing a state where a pushback surface is in contact with the cam pin.

On the other hand, only a front portion, preferably about the front half, of each cam pin 13 is at the entrance 44A of the corresponding cam groove 44 as shown in solid line in FIG. 8(A) when the two housings 10, 20 are at the preventing position PP where connection of two wrongly paired housings 10, 20 is prevented. Accordingly, a rear portion, preferably about the rear half, of each cam pin 13 is outside the end edge of the arm 41. Rotation of the lever 40 in this state causes each push-back surface 49 to contact the corresponding cam pin 13 from a lower-front side, as shown in FIG. 8(B). At this time, an angle (θ) between a contacting direction of the push-back surface 49 with the cam pin 13, i.e. a normal direction (direction F) at a point of contact of the cam pin 13 and the push-back surface 49, and a connection axis of the two housings 10, 20 (direction F1) is equal to or smaller than about 45°.

The lever 40 initially is at the starting position with respect to the female housing 20, and the tubular fitting 11 of the male housing 10 is fit into the receptacle 21 of the female housing 20. The rib 32 substantially aligns with the groove 17 of the erroneous connection preventing portion 16 if the combination of the male and female housings 10, 20 is correct. Thus, the two housings 10, 20 are connected up to the initial connection position ICP shown in FIG. 5. At this time, the cam pins 13 substantially entirely enter the entrances 44A of the cam grooves 44 (see phantom in FIG. 8(A)). In this process, the unlocking projections 14 contact the locking pieces 46 of the lever 40 and resiliently deform the locking pieces 46 out of engagement with the female housing 20. Thus, the lever 40 is released from its rotation-prevented state.

Fingers are placed on the operable portion 48 of the lever 40 to rotate the lever 40 in the connection rotation direction CRD shown in FIG. 5. Thus, the cam pins 13 enter the connection guiding grooves 44B and move towards the termini 44C. As a result, the housings 10, 20 are pulled toward each other by a cam function and are connected gradually. Then, the leading ends of the tab 12 enter the terminal connecting portions 26 of the female terminal fittings 25 to contact the resilient contact pieces 27.

The leading end of the lock arm 47 contacts the lock projection 34 and is deformed sufficiently to move onto the upper surface of the lock projection 34 when the lever 40 approaches the ending position. The leading end of the lock arm 47 then moves beyond the lock projection 34 and the lock arm 47 is restored resiliently to engage the lock projection 34 (see FIG. 6). In this way, the lever 40 is held at the ending position and the two housings 10, 20 are locked in their properly connected state.

An attempt could be made to assemble the housings 10, 20 in a wrong combination. In this situation, the rib 32 is displaced from the groove 17 and contacts the front surface of the erroneous connection preventing portion 16, as shown in FIG. 7. Thus, connection of the two housings 10, 20 is prevented at the preventing position PP, which is before the initial connection position ICP. At this time, only about the front halves of the cam pins 13 are in the entrances 44A of the cam grooves 44, as shown in FIG. 8(A). An operator may try to rotate the lever 40 in this state. However, the push-back surfaces 49 contact the corresponding cam pins 13 from the lower-front side, as shown in FIG. 8(B), and the cam pins 13 are subjected to a pushing force F that acts in the contacting direction of the push-back surfaces 49, i.e. normal to the tangents at the points of contact of the cam pins 13 and the push-back surfaces 49. This pushing force F has a component F1 acting in along the connection axis and in the connection direction CD and a component F2 acting vertically in a direction normal to the connecting direction CD. The component F1 of the pushing force F exerted on the cam pins 13 by the push-back surfaces 49 exceeds a frictional resistance between the two housings 10, 20. Thus, the cam pins 13 are pushed back to separate the housings 10, 20. In this way, the erroneous connection of the housings 10, 20 can be detected.

The push-back surfaces 49 may contact the cam pins 13 in a downwardly tilted direction if the angle θ between the contacting direction of the push-back surfaces 49 with the cam pins 13 and the connection axis is relatively large. In this situation, the value of the component F1 is smaller than the value of the component F2. Thus, the pushing force F necessary to separate the two housings 10, 20 becomes larger, and such a force may damage the lever 40. However, the angle θ is equal to or smaller than about 45°. Thus, the value of the component F1 is relatively large, and the housings 10, 20 can be separated with a small pushing force F, thereby preventing the lever 40 from being damaged and increasing the overall operability.

As described above, the connection of the two housings 10, 20 is prevented at the preventing position PP located before the initial connection position ICP with respect to the connecting direction CD if the two housings 10, 20 are connected erroneously. When the lever 40 is rotated in this state, the push-back surfaces 49 push the cam pins 13 back to separate the housings 10, 20. In this way, the lever 40 will not damaged.

The push-back surfaces 49 for pushing the cam pins 13 back are formed at the inner sides of the cam grooves 44. Thus, a function for pushing the cam pins 13 back can be realized by a simple construction without influencing the entire constructions of the housings 10, 20, the outer shape of the lever 40 and the like.

Figure 9:
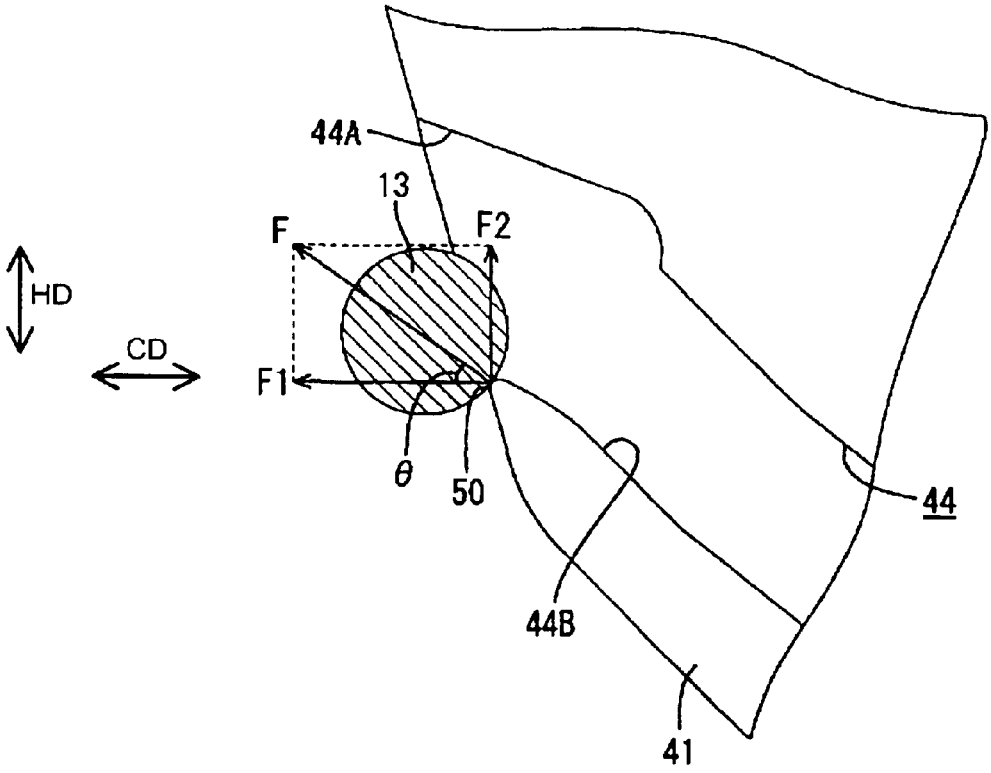
FIG. 9 is a partial enlarged section showing a state where a pushback surface is in contact with a cam pin in a second embodiment.

A second embodiment of the invention is described with reference to FIG. 9. Although the push-back surfaces 49 of the first embodiment are substantially flat, push-back surfaces 50 of this embodiment are convex. Since the other construction is similar or the same as in the first embodiment, no description is given thereon by identifying it by the same reference numerals.

Portions around the cam pin 13 and the push-back surface 50 are made e.g. of a synthetic resin, and are deformed resiliently if a large force is exerted thereon in directions to press the cam pin 13 and the push-back surface 50 against each other. This leads to increased contact areas of the cam pins 13 and the push-back surfaces 50 to increase friction between them. Accordingly, an extra force is required to push the cam pin 13 back. Contrary to this, the push-back surfaces 50 of the second embodiment are convex to make contact areas with the cam pins 13 smaller and such round surfaces can suppress friction acting between the cam pins 13 and the push-back surfaces 50.

The invention is not limited to the above described and illustrated embodiments. For example, the following embodiments also are embraced by the invention as defined by the claims. Various other changes can be made without departing from the scope of the invention as defined by the claims.

Although the lever is mounted on the female housing in the foregoing embodiment, it may be mounted on the male housing.

The erroneous connection preventing means prevents connection of the male and female housings when the combination thereof is wrong in the foregoing embodiments. However, the connection may be prevented when the usings are assembled with the one inverted about the respect to the other according to the invention.

Although a lever has been described as a preferred operable member it should be understood that the invention is applicable to other operable members, such as a slider, with cam means for cooperating with mating cam means on at least one of the housings to display a cam action when the operable member is operated. The operable member may be operated along a substantially linear path or another different path.

What is claimed is:

1. A connector, comprising:

first and second housings connectable with each other, a movable member formed with a cam groove and movably provided on the first housing, a cam pin provided on the second housing, the housings being pulled toward each other to be properly connected as the movable member is moved from an initial connection position where the housings are fit lightly together while the cam pin is engaged with the cam groove, an erroneous connection preventing means for preventing the connection of the housings at a preventing position which is located before the initial connection position and where at least a part of the cam pin is located in the cam groove upon erroneously connecting the two housings, and a push-back surface at an opening edge of the cam groove and capable of exerting a force on the cam pin at the preventing position and in a direction to separate the housings, the push-back surface being configured such that the force is larger than a frictional resistance between the housings.

2. The connector of claim 1, wherein the movable member is a lever rotatably provided on the first housing.

3. The connector of claim 1, wherein a contacting direction of the push-back surface with the cam pin defines an angle of no more than about 45° to a connection axis of the housings.

4. The connector of claim 1, wherein the push-back surface comprises a convex surface.

5. The connector of claim 1, wherein the cam pin contacts the push-back surface at a point of tangency upon erroneously connecting the two housings, a line passing centrally through the cam pin at the point of tangency defines an angle of no more than about 45° to a connection axis of the housings.

6. The connector of claim 1, wherein the erroneous connection preventing means comprises at least one groove and at least one rib which is insertable into the groove upon proper connection of the two housings.

7. A set of connectors comprising at least two connectors according to claim 6.

8. The set of connectors of claim 7, wherein positions of the rib and the groove differ for each pair of housings among a set of connectors so that the housings can be connected only in a correct combination.

9. A connector, comprising:

first and second housings connectable with each other along a connecting direction, a cam pin provided on the second housing;

a lever mounted on the first housing for rotation in a connection rotation direction, the lever having a cam groove configured for engaging the cam pin when the housings are fit lightly together at an initial connection position and pulling the housings towards each other as the lever is rotated in the connection rotation direction; and a push-back surface at an opening edge of the cam groove and at a trailing side of the cam groove relative to the connection rotation direction, the push-back surface being configured and disposed for exerting a force on the cam pin in a direction opposite the connecting direction if the lever is rotated in the connection rotation direction before the housings reach the initial connection position, the push-back surface further being configured such that the force is larger than a frictional resistance between the housings.

10. The connector of claim 9, further comprising an erroneous connection preventing means for permitting connection of two properly matched housings and preventing connection of two improperly matched housings at a preventing position which is located before the initial connection position and where only a part of the cam pin is in the cam groove.

11. The connector of claim 9, wherein at least part of the push-back surface is convex.

12. The connector of claim 9, wherein the cam pin contacts the push-back surface at a point of tangency, a line passing centrally through the cam pin and through the point of tangency defines an angle of no more than about 45° to the connection direction of the housings.

13. A connector, comprising:

first and second housings connectable with each other along a connecting direction, a cam pin provided on the second housing;

a movable member mounted on the first housing for movement in a movement direction at an angle to the connecting direction, the lever having a cam groove configured for engaging the cam pin when the housings are fit lightly together at an initial connection position and pulling the housings towards each other as the lever is moved in the movement direction; and a push-back surface at an opening edge of the cam groove and at a trailing side of the cam groove relative to the movement direction, the push-back surface being configured and disposed for exerting a force on the cam pin in a direction opposite the connecting direction if the movable member is rotated in the connection rotation direction before the housings reach the initial connection position, the push-back surface further being configured such that the force is larger than a frictional resistance between the housings.

14. The connector of claim 13, further comprising an erroneous connection preventing means for permitting connection of two properly matched housings and for preventing connection of two improperly matched housings at a preventing position which is located before the initial connection position and where only a part of the cam pin is in the cam groove.

15. The connector of claim 14, wherein at least part of the push-back surface is convex.

* * * * *